United States Patent [19]

Ellis

[11] Patent Number: 4,761,648

[45] Date of Patent: Aug. 2, 1988

[54] REMOTE SENSING SYSTEMS

[75] Inventor: Lyndon Ellis, Didcot, England

[73] Assignee: Racal Security Limited, Newbridge, Scotland

[21] Appl. No.: 557,478

[22] Filed: Dec. 2, 1983

[30] Foreign Application Priority Data

Dec. 2, 1982 [GB] United Kingdom ..... 8234438

[51] Int. Cl.[4] ..... G08C 19/24

[52] U.S. Cl. ..... 340/825.64; 340/539; 340/825.69

[58] Field of Search ..... 340/825.69, 825.64, 340/539

[56] References Cited

U.S. PATENT DOCUMENTS

| | | | |
|---|---|---|---|
| 3,579,190 | 5/1971 | Karras | 340/825.64 X |
| 3,848,231 | 11/1974 | Wootton | 340/539 X |
| 3,852,718 | 12/1974 | De Lyria | 340/825.64 X |
| 4,020,477 | 11/1975 | Holland | 340/539 X |
| 4,186,345 | 1/1980 | Marita et al. | 340/825.64 |
| 4,251,812 | 2/1981 | Okada et al. | 340/825.64 X |
| 4,358,756 | 11/1982 | Morel et al. | 340/539 |

FOREIGN PATENT DOCUMENTS

| | | |
|---|---|---|
| 2913266 | 10/1980 | Fed. Rep. of Germany . |
| 1476261 | 6/1977 | United Kingdom . |
| 1531316 | 11/1978 | United Kingdom . |

*Primary Examiner*—Joseph A. Orsino, Jr.
*Assistant Examiner*—Brian R. Tumm
*Attorney, Agent, or Firm*—Leydig, Voit & Mayer

[57] ABSTRACT

A security installation comprises sensors arranged in and around a building which transmit digital information to a central station by radio, in each case preceded by an access code specific to the particular installation; signals inadvertently received from the sensors of an adjacent installation are rejected. The information is transmitted by encoding a multiple bit word incorporating the access code, a code identifying the particular sensor, and the actual data, using Manchester II coding on an FSK transmission. Each such word is sent several times to form a data packet. The master station tests the received data for the correct format and for the correct access code. Recognition is only complete when within a particular packet, at least two (say) sequential words and at least two other words are recognized.

8 Claims, 2 Drawing Sheets

REMOTE SENSING SYSTEMS

BACKGROUND OF THE INVENTION

The invention relates to remote sensing systems, that is, systems having one or more sensors for sensing particular parameters or changes in such parameters and which are remote from a station which is intended to respond to information received from the sensor or sensors. One particular example of such a system is a security system in which there are a plurality of sensors situated at different positions in an area to be monitored (such as a building or house or part of a building such as a flat or apartment) and arranged to sense (for example) the presence of an intruder, the movement of an object, fire or smoke or inadvertent escape of a substance such as gas or water, each sensor being arranged to transmit signals representative of what it is sensing to a master station which is in or near the area being monitored and which then responds by taking appropriate action such as emitting a warning signal or causing such a signal to be transmitted to a distant location (as by means of a telephone line).

SUMMARY OF THE INVENTION

According to the invention, there is provided an information transmission system, comprising a plurality of remote units for transmitting information to a respective master station by radio, each signal being transmitted in association with an access code identifying the signal as being intended for that particular master station, each remote unit transmitting each signal a plurality of times in succession, and in which the master station comprises recognition means operative to recognise received signals only when the format of each received signal agrees with the predetermined format, each received signal is received in association with the said access code, and at least a predetermined plurality of identical signals are received within a predetermined time.

According to the invention, there is also provided an information transmission method for transmitting information from a plurality of remote sources to a master station by radio, each signal being transmitted in association with an access code identifying the signal as being intended for that particular master station, in which each signal is transmitted a plurality of times in succession, and in which the master station recognises received signals only when the format of each received signal agrees with the predetermined format, each received signal is received in association with the said access code, and at least a predetermined plurality of identical signals are received within a predetermined time.

DESCRIPTION OF THE DRAWINGS

A security installation embodying the invention will now be described by way of example only and with reference to the accompanying drawings in which.

DESCRIPTION OF PREFERRED EMBODIMENTS

Figure 1:
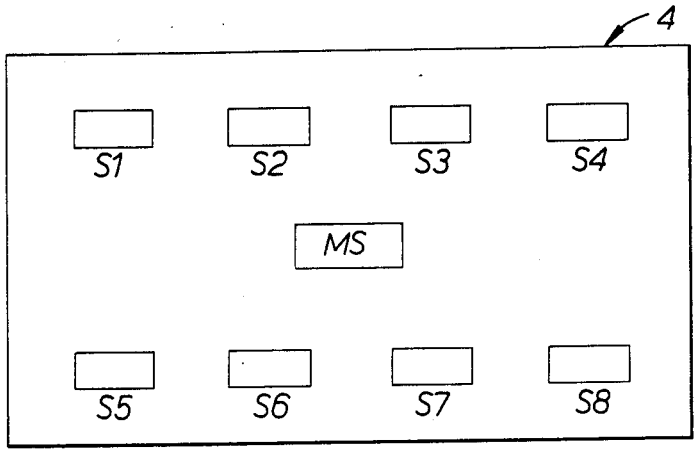
FIG. 1 is a block diagram of one of the installations.

As shown in FIG. 1, the security installation has eight (in this example) sensors S1, S2 . . . S8 which are distributed around an area to be monitored, which might be a building 4. Located in or near the building is a master station MS. Each sensors S1 to S8 is arranged to detect a particular occurrence, as explained above; for example, the presence of an intruder, the movement of an object (e.g. removal of a painting), fire or smoke, or undesired escape of a potentially damaging or dangerous substance such as water or gas. In response to such detection, each sensor signals accordingly to the master station MS which then takes appropriate preventative or warning action. Communication between the sensors and the master station is by means of radio, thus considerably easing the problems involved in installing the system in an existing building such as occur with systems in which the sensors are connected to the master station by wired links. Advantageously, the sensors S1 to S8 have very low power consumption and incorporate their own power supplies.

Figure 2:
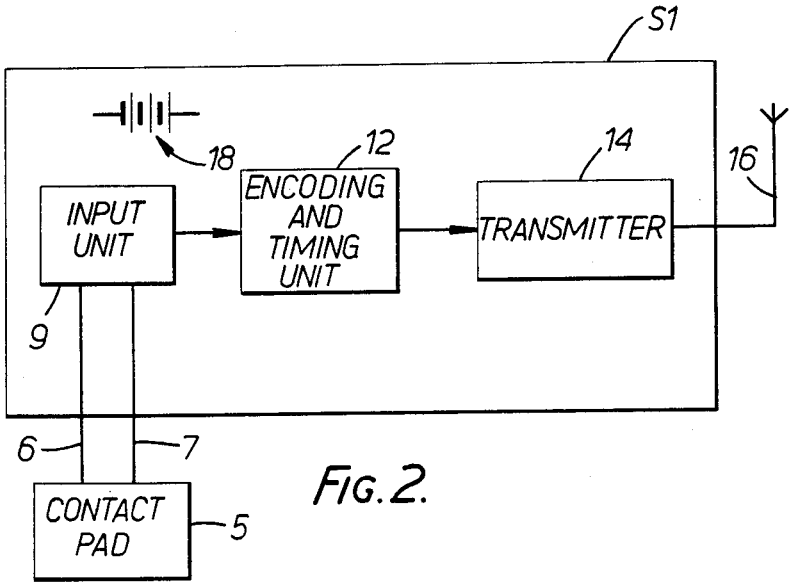
FIG. 2 is a block diagram of a sensor in the installation of FIG. 1.

FIG. 2 shows diagrammatically one of the sensors S1 in more detail. As shown, it comprises a contact pad or mat 5 (in this example) such as for placing under a floor covering adjacent a door or window in the building under surveillance so that contacts are closed when an intruder steps on the floor covering, and a corresponding electrical signal is produced on lines 6 and 7 which are connected to an input unit 9.

The latter produces a corresponding electrical output signal which is fed to an encoding and timing unit 12. This encodes the signals into suitable form to modulate a radio transmitter 14 which transmits the signals via an antenna 16 to the master station MS.

The units of the sensor are powered by a battery power supply indicated at 18, the connections between this and the units of the sensor being omitted for clarity.

The signals produced by the input unit 9 are preferably produced in digital form and transmitted over the radio link in any suitable way such as by frequency shift keying.

It will be appreciated that installations such as shown in FIG. 1 may inevitably be positioned adjacent to each other, such as in adjacent apartments in an apartment block. Although the sensors are arranged to radiate at low power (this will normally be required by Government regulations in any case), it will not be possible to ensure that the signals radiated by the sensors of one installation will not reach the master station of an adjacent installation. Therefore, in order to prevent the master station from reacting to signals radiated by by the sensors of another installation, the radio signals transmitted by the sensors of each installation are prefixed by an "access code" which is particular to that installation and is recognised only by the master station of that installation.

Figure 3:
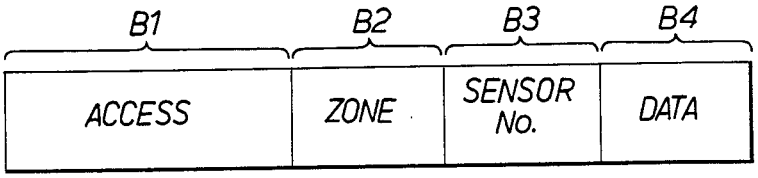
FIG. 3 illustrates the format of data signals transmitted in the installation of FIG. 1.

FIG. 3 shows one form which the information produced by a sensor can take. In this example, the information comprises 20 bits arranged in blocks.

Block B1 contains eight bits and represents the access code which is particular to that installation. Block B2 consists of four bits and identifies the zone (e.g. a particular room) in which the sensor is located.

Block B3, also of four bits, identifies the serial number of the sensor within the particular zone. Finally, block B4, again of four bits, is the actual data, that is, representing the state of the sensor (the state of the contact pad 5 in this particular example).

In the encoding and timing unit 12, the twenty bits shown in FIG. 3 are encoded by the unit 12 (FIG. 2) into a more complex structure so that the original twenty bits appear as a fifty bit word. This conversion process is for the purpose of providing additional security.

More specifically, the additional thirty bits may include a pseudo-random number (to be described in more detail below), a parity bit, and error checking and synchronisation bits.

The fifty bit word so produced is then transmitted serially by the transmitter 14 (FIG. 2) using Manchester II coding on an FSK transmission. The transmission repeats the fifty bit word sixteen times and the sixteen words form a "packet". Each such packet is approximately 50 milliseconds in duration. Eight such packets form a "message".

In the system being described, it will be appreciated that it would be possible for two or more sensors to detect a particular situation or change in a situation substantially simultaneously. For example, two sensors in a room might simultaneously detect fire, or two sensors on a pair of double doors might simultaneously detect opening of the doors by an intruder. In such a case, it would be disadvantageous if each of the two (or more) simultaneously activated sensors were to transmit data to the master station. The signal from one sensor might mask the signal from another and/or might corrupt it. In order to avoid this possibility, each sensor within a particular zone (e.g. a particular room) is arranged to initiate transmission of its signal to the master station at a predetermined time after the occurrence of the situation or change in situation giving rise to that signal, but the subsequent time gaps between the "packets" of the complete "message" are different for each sensor in that zone. For example, each sensor within a zone has a particular sensor number (represented by the four bits in block B3, see FIG. 3), and the predetermined time elapsing between the packets transmitted by that sensor may be dependent on the value of that sensor number.

The encoding and timing processes necessary for producing the information in this format are carried out by the encoding and timing unit 12 in each sensor.

The sensors may be arranged to operate in a variety of ways. For example, they may be normally quiescent but arranged to respond to a change in the situation being monitored (closure of the contacts in the contact pad in the case of the sensor of FIG. 2) by transmitting a "message" as explained above, the message carrying the data indicating the changed situation. At the end of the message, the monitored situation is reviewed and, if it has changed, a new message is transmitted, carrying revised data.

If desired, the sensors can also be arranged so as automatically to transmit a message at regular or irregular intervals, whether or not there has been a change in the situation being monitored.

Figure 4:
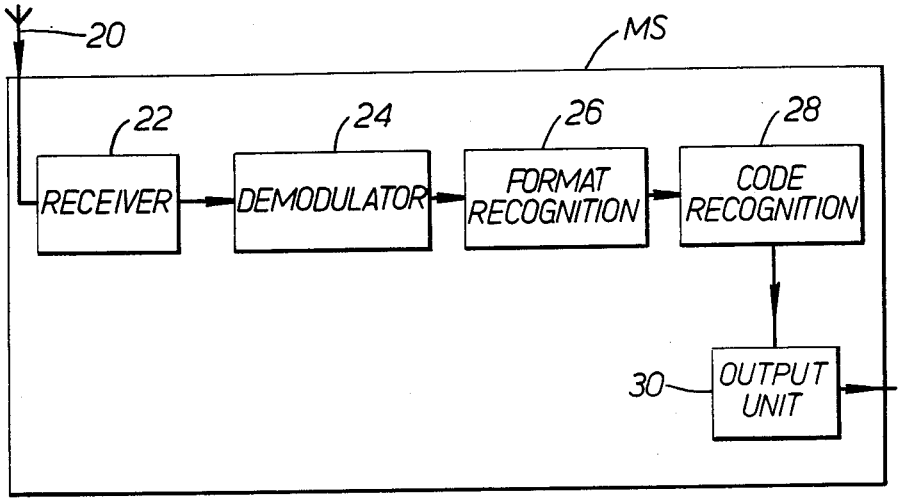
FIG. 4 is a block circuit diagram of a master station used in the installation.

FIG. 4 shows the master station in block diagram form.

The master station has a receiving antenna 20 which feeds the received signals to a receiver 22. The received signals are demodulated in a demodulator 24 and the demodulated signals are fed to a format recognition unit 26. This checks that the code structure of the received, demodulated signals is correct, that is, is of Manchester II form. In addition, it transforms each fifty bit word back into the original twenty bit form shown in FIG. 3. This process involves recovering the error checking, parity and synchronisation bits and responding accordingly to each. In addition, it involves recognising the pseudo-random number mentioned above.

The pseudo-random number is in fact a specially selected multi-bit number. In the master station, the same number is pre-stored and compared bit by bit with the incoming 50 bit word. The pseudo-random number is specially selected so that as it is compared with the received word, it correlates poorly until it is exactly in bit alignment with the received bits of the transmitted pseudo-random number (assuming of course that the latter is the correct number—that is, that no errors have occurred in transmission). If the transmitted pseudo-random number is incorrect, correlation will be low even if the difference from the correct number is small. Similarly, even if the transmitted number is correct, correlation will be poor until it is in exact bit alignment with the correct number stored at the master station. The pseudo-random number can be used to initiate the synchronisation process (which is then continued by the synchronisation bits).

After completion of this process, the twenty bit word is then passed to a code recognition unit 28. This checks the access code (block B1, FIG. 3) to establish whether the received transmission has originated from a sensor with the particular installation.

The code recognition unit 28 does not indicate recognition immediately it has recognised one twenty bit word as originating from a sensor within the correct installation. The unit 28 is in fact programmed to indicate recognition only when, within a single packet (of sixteen words, see above) it recognises two sequential words and two more words within the packet which are identical with the sequential words but not necessarily sequential with them or with each other. If these requirements are satisfied, the code recognition unit 28 indicates recognition, and a data output unit 30 extracts the data (block B4) and responds accordingly, as by giving an alarm and/or transmitting an alarm signal to a distant location.

In fact, each packet is transmitted a further seven times (in this example), and the unit 28 indicates recognition if it recognises the words referred to above in at least one of the packets. If desired, the system may be arranged so that the two words which are not necessarily sequential may be in a different packet from the two sequential words (and of course identical with them).

It will be seen, therefore, that the recognition process involves a number of different stages.

First, the received signals must be of the correct format to be capable of being demodulated by the demodulator 24. Secondly, the received signals must have the correct code structure to be recognised by the unit 26. Thirdly, the signals must have the correct access code to be recognised by the unit 28. It will be appreciated, however, that detailed operation of the encoding, decoding and recognition processes described above may be varied without departing from the scope of the invention.

What is claimed is:

1. An information transmission system, comprising a master station, a plurality of remote sensors each for transmitting information signals to the master station by radio when it detects a local change in conditions, each signal being transmitted in a message in which it is associated with an access code identifying the signal as being intended for that particular master station, each sensor transmitting each signal a plurality of times in succession in the message, the master station comprising recognition means operative to recognise signals ony when the format of each received message agrees with a predetermined format, each received signal is received in association with the said access code, and at least a predetermined plurality of identical signals are received within a predetermined time, each sensor in a group which comprises at least some predetermined and physically adjacent ones of the sensors including means responsive to the identity of the particular sensor for controlling the length of the gaps between the successive signals in each message which it transmits so as to render that length dependent on the identity of the sensor and different from the corresponding length applicable to the or each other of the sensors in the said group whereby to prevent the signals produced by any one of the sensors in the said group in response to occurrence of a local change in conditions from masking or corrupting the signals produced by any other one of the sensors in the said group in response to occurrence of the same local change in conditions.

2. A system according to claim 1, in which the recognition means includes means operative to indicate recognition only when four identical signals are received within said predetermined time.

3. A system according to claim 1, in which the recognition means includes means operative to indicate recognition only when two or more identical signals are received in immediate succession and at least two or more other signals, identical with the said at least two signals received in immediate succession, are received within said predetermined time.

4. An information transmission method for transmitting information signals from a plurality of remote sensors to a master station by radio, each signal being transmitted in a message in which it is associated with an access code identifying the signal as being intended for that particular master station, each signal being indicative of detection of a local change in conditions by the respective sensor, in which each signal is transmitted a plurality of times in succession in the message, the master station recognises received signals only when the format of each received message agrees with the predetermined format, each received signal is received in association with the said access code, and at least a predetermined plurality of identical signals are received within a predetermined time, each sensor in a group which comprises at least some predetermined adjacent ones of the sensors controlling the length of the gaps between the successive signals in each message which it transmits in dependence on the identity of that sensor so as to render that length dependent on the said identity and different from the corresponding length applicable to the or each other of the sensors in the said group, whereby to prevent the signals produced by any one of the sensors in the said group in response to occurrence of a local change in conditions from masking or corrupting the signals produced by any other of the sensors in the said group in response to occurrence of the same local change in conditions.

5. A method according to claim 4, in which the master station recognises the received signals only when four identical signals are received within said predetermined time.

6. A method according to claim 5, in which the master station recognises received signals only when two or more identical signals are received in immediate succession and at least two or more other signals, identical with the said at least two signals received in immediate succession, are received within said predetermined time.

7. A method according to claim 4, in which the times of transmissions of the said signals are relatively short compared with the gaps between successive signals.

8. A system according to claim 7, in which the remote units transmit sequentially.

* * * * *